US005303570A

United States Patent [19]

Kaiser

[11] Patent Number: 5,303,570

[45] Date of Patent: Apr. 19, 1994

[54] HYDROSTATICALLY DEFORMING A HOLLOW BODY

[75] Inventor: Wilhelm Kaiser, Sundern, Fed. Rep. of Germany

[73] Assignee: HDE Metallwerk GmbH, Menden, Fed. Rep. of Germany

[21] Appl. No.: 927,398

[22] PCT Filed: Jan. 31, 1992

[86] PCT No.: PCT/DE92/00060

§ 371 Date: Sep. 23, 1992

§ 102(e) Date: Sep. 23, 1992

[87] PCT Pub. No.: WO92/13653

PCT Pub. Date: Aug. 20, 1992

[30] Foreign Application Priority Data

Feb. 1, 1991 [DE] Fed. Rep. of Germany ..... 4103082

[51] Int. Cl.[5] ..... B21D 39/20; B21D 26/02

[52] U.S. Cl. ..... 72/62; 72/61; 29/421.1

[58] Field of Search ..... 72/58, 59, 61, 62; 29/421.1

[56] References Cited

U.S. PATENT DOCUMENTS

| | | | |
|---|---|---|---|
| 1,542,983 | 6/1925 | Bergmann, Jr. | 72/61 |
| 3,072,085 | 1/1963 | Landis . | |
| 4,467,630 | 8/1984 | Kelly | 72/62 |
| 4,928,509 | 5/1990 | Nakamura | 72/61 |
| 4,951,492 | 8/1990 | Vogt | 72/61 |
| 5,097,689 | 3/1992 | Pietrobon | 72/61 |

FOREIGN PATENT DOCUMENTS

| | | | |
|---|---|---|---|
| 78551 | 5/1983 | European Pat. Off. | 72/61 |
| 0086480 | 8/1983 | European Pat. Off. . | |
| 250838 | 1/1988 | European Pat. Off. . | |
| 0347369 | 10/1990 | European Pat. Off. . | |
| 272042 | 9/1968 | Fed. Rep. of Germany . | |
| 3105735 | 8/1982 | Fed. Rep. of Germany . | |
| 9318 | 7/1962 | Japan | 72/61 |
| 84231 | 6/1980 | Japan | 72/61 |
| 80878 | 2/1956 | Netherlands . | |
| 835259 | 5/1960 | United Kingdom . | |

OTHER PUBLICATIONS

Industrie-Anzeiger No. 20 of Mar. 8, 1984, Year 10, pp. 16, 17.

*Primary Examiner*—David Jones

*Attorney, Agent, or Firm*—Herbert Dubno; Andrew Wilford

[57] ABSTRACT

A hollow workpiece having a tubular end portion is deformed by first fitting the workpiece into a die formed with a cavity adapted to receive the workpiece with the end portion of the workpiece projecting along an axis out of the die and then engaging over the projecting end portion of the workpiece a feed sleeve in a pressure-tight fit. The sleeve and workpiece are supported relative to each other such that the holding portion can slide in the sleeve and that the sleeve exerts substantially no axial force on the workpiece. Then an interior of the workpiece is pressurized through the sleeve and to deform the workpiece outward against an inner surface of the die.

10 Claims, 5 Drawing Sheets

HYDROSTATICALLY DEFORMING A HOLLOW BODY

FIELD OF THE INVENTION

The invention relates to a method of hydrostatically deforming hollow bodies of cold-shapable material inside a cavity of a die where pressurized fluid is fed from outside into the hollow body so as to force a wall of the hollow body against an internal surface of the die in a deformation region with the hollow body being held outside the deformation region by at least one holding region.

BACKGROUND OF THE INVENTION

In the above-described type of process (see *Industrie-Anzeiger* No. 20 of 08 Mar. 1984/ 10 yr. pages 16 and 17) tubular hollow parts of cold-deformable metal, for instance 16 MnCr 5, are deformed by the application of high internal hydrostatic pressure. Added to the high hydrostatic internal pressure there is a particular axial pressure that is effective on the end surfaces. This axial pressure and the simultaneous effect of the internal pressure have the result that the wall of the hollow body conforms to the surface of the mold or die.

In practice a straight tube is positioned in the separation plane between upper and lower die halves and the die is closed. Between the upper and lower die halves there is however sufficient space for two diametrally opposite coaxial arranged horizontal rams whose free end faces confront and engage the tube to be deformed The deformation takes place by feeding pressurized fluid into the interior of the tube while simultaneously exerting axial pressure by pushing the two rams toward each other.

With the known hydrostatic deformation it is possible to produce parts with uniform shape around their circumference, parts with sectoral deformation, and also parts with uniform and sectoral deformation combined.

The advantage of hollow parts produced in this manner is primarily that, as for instance with chill casting, undercut internal spaces can be produced which could not be produced by machining or could only be done with complicated tools (for instance by spark erosion). In addition the known hollow parts—in contrast to hollow parts produced by machining—are relatively light and as a result of the cold forming from the deforming when the fibers are properly oriented are particularly strong like forged goods.

Nonetheless the known internal high-pressure deformation has been found disadvantageous because a certain minimum thickness of the wall of the hollow body cannot be exceeded. This is mainly due to the fact that the tubular bodies must be made stiff enough to resist a relatively high pressure exerted on their ends, which can only be achieved with a certain minimum wall thickness.

In addition the known internal high-pressure deformation can only be used with parts where the axial force coincides exactly to the centerline of the tube and of the die. In this manner it is possible to produce substantial lateral sectoral deformations for producing, for example, crosspieces or T-pieces. In this case the longitudinal axis extends in accordance with the die's sectoral produced outward deformation transversely to the common force lines of the rams and of the tube (see *Industrie-Anzeiger* op. cit. page 17, FIGS. 4 and 8).

With the known internal high-pressure deformation it is possible to produce a certain number of shapes which however always lie within the framework of common lines of force of the rams and the tube to be deformed, thus for a straight basic shape.

OBJECTS OF THE INVENTION

Starting from the above-described known device (see *Industrie-Anzeiger* op. cit.), it is an object of this invention to change the known method to permit thin-walled and if necessary nonstraight hollow bodies to be deformed into more complex shapes than is possible with the known method.

SUMMARY OF THE INVENTION

This object is attained according to the invention in that the hollow body is floatingly held at each holding region without axial forces and the hollow-body wall is only moved by liquid pressure relative to the die, in particular drawn into same.

Whereas with the deformation process of the known method (see *Industrie-Anzeiger* op. cit.) the movement of the hollow body relative to the die cavity takes place from the combined effects of the axial pressure and the inner pressure, this takes place according to the invention solely by the effect of the pressurized liquid as a stretching deformation. By movement of the hollow-body wall relative to the die any movement of a given point of the hollow-body wall relative to the cavity surface can be permitted.

The hydrostatic deformation according to the invention is possible because the hollow body is floatingly held at each holding region without axial force. This means that the method of the invention can be contrasted with the known method (see *Industrie-Anzeiger* op. cit.) to solve a force problem so that not only hollow bodies of straight shape, but also hollow bodies of various curved shapes can be produced.

The automatic equalization of the wall thickness between the inner and outer curve sides of a bent tube blank is effected in that the hydrostatic pressure as a result of the greater effective surface area in the outer side of the curve causes the blank to first move in the region of the outer curve side to lie on the cavity surface. The thicker wall of the inner curve is then, as a result of the delayed higher pressure, pressed on the die surface across from the inner curve side. This takes place such that any inner radius can freely be selected and simultaneously the wall thicknesses can be minimized.

The inventive method permits in addition certainly a "control of wall thickness." This is achieved in that in those regions at which the hydrostatic deformation, a thinning of the wall, is to be produced, a spacing is set between the outer surface of the hollow-body wall and the inner die surface with this spacing being generally proportional to the desired amount of deformation. Thus the invention proposes that, during the deformation, movements of the hollow-body wall relative to the die are set relative to the desired thickness to the hollow-body wall.

Another development of the inventive teachings is according to further features of the invention that at least one selected region of the hollow body is formed prior to its hydrostatic deformation with an indent location. This can mean according to the article shape that, after complete deformation of the hollow-body wall, the region of its previously existing indent is of unchanged thickness because only a smoothing of the hollow-body wall—thus a removal of the indent—takes place while the thickness of neighboring wall regions is decreased because of its spacing from the die wall.

It should be added that the above-mentioned indent of the hollow-body wall can be created in any manner, preferably by outside mechanical forces.

A particular advantageous embodiment of the inventive method is that in order to obtain a smooth deformation of the hollow body it is curved, e.g. bent or the like, by mechanical force prior to the hydrostatic deformation. This feature is based on the recognition that coarsely curved basic shapes can be produces with simple mechanical means by hydrostatic deformation.

When the finished deformed hollow body should have for example an S-shape, this is produced according to the above feature of the invention not hydrostatically but with relatively simple devices, for example with a mechanical tube bender. After the externally effected mechanical forces that shape the hollow body, it is set in the die and there is hydrostatically deformed. The indents created by the previous bending at the tube outer-curve sides are fully smoothed by the hydrostatic deformation. The indent regions on the outer curve sides can if necessary be made relatively deep because in this manner by a displacement of the deformation work into the outer regions folds on the inner curve sides can be avoided.

The invention basically proposes that the hollow body is hydrostatically deformed in several succeedingly higher pressure regions or steps of the liquid.

In this respect the invention proposes according to a possibility that the transition from one pressure region or from one pressure step to the next higher on follow each other immediately and substantially without transition an this hydrostatic deformation takes place in the same die. The transitionless passage from one pressure region or from one pressure step to the next higher on is important because during an otherwise occurring stop in the deformation the majority of the cold-shapable metals freeze so that—without the use of additional means—no further deformation of the hollow body can take place.

When hollow bodies are to be produced by hydrostatic deformation that have a high degree of deformation, the widening-associated hydrostatic deformations correspond to another possibility of the invention in that the hydrostatic deformation of the hollow body takes place in several different dies in which the respective hydrostatic deformations take place over at least one pressure range or over at least one pressure step of the pressurized liquid.

According to the invention the hydrostatic deformation takes place in each die such that before starting the hydrostatic deformation the pressurized fluid is first admitted into the hollow body at a filling pressure and thereafter an increase of the liquid pressure takes place whose maximum high pressure is a multiple of the filling pressure.

Here the level of the deformation pressure is 30 to 50 times the level of the filling pressure.

A substantial goal of the method of the invention is to produce hollow bodies of identically precise characteristics. To do this it is important that the material lies during the deformation always by partial tolerances precisely and without slipping on the surface of the die cavity. In order to attain this with sureness, the invention proposes that the necessary deformation pressure for the hydrostatic deformation of a hollow body is increased by an additional pressure. The invention thus operates with a pressure reserve. When for example for deforming a hollow body a deformation pressure of 1350 bar is enough, the invention proposes a pressure increase to for example 1500 bar. The additional pressure of 150 bar ensures that the wall of the hollow body lays uniformly, flatly, and without moving on the wall of the die cavity.

A particularity of the inventive method is that during the hydrostatic deformation the air already in the hollow body is compressed by means of the pressurized liquid and after the hydrostatic deformation is complete the pressure supply for the pressurized liquid is shut off so that the compressed air decompresses and thus forces the liquid out of the hollow body.

As already stated, inside the die only limited deformation can be produced so that for substantial deformations several dies are needed in which the deformation can be conducted stepwise. With all known cold-shapable metals which tend to freeze after each cold-forming step, the invention proposes that after each complete hydrostatic deformation step, e.g. inside a particular die, before the succeeding particular hydrostatic deformation in the next die there is a recrystallization of the hollow body by normalizing. With St 34 or St 37 the temperature for normalizing or annealing reaches about 920°-930° C.

Of course the invention allows between two hydrostatic deformation steps a purely mechanical intermediate deformation so that the basic shape after complete hydrostatic deformation can additionally be changed as desired.

The invention also relates to an apparatus for carrying out the method. Such an advantageous apparatus is set up according to the invention such that the holding region of the hollow body inside the die is surrounded in a pressure-tight manner by a sleeve that can slide on it. The pressure-tight receiving of such a hollow-body holding region ensures that the hollow body is held altogether substantially without axial forces. This axial-force-free slide holding ensures in a particularly advantageous way that the hollow-body deformation reaction can under the effect of the hydrostatic internal pressure deform both axially in stretching as well as radially and thus automatically can "draw" material out of the holding regions.

BRIEF DESCRIPTION OF THE DRAWING

The drawing shows the method according to the invention and the apparatus for carrying out the method with reference to preferred embodiments in detail, where.

SPECIFIC DESCRIPTION

Figure 1:
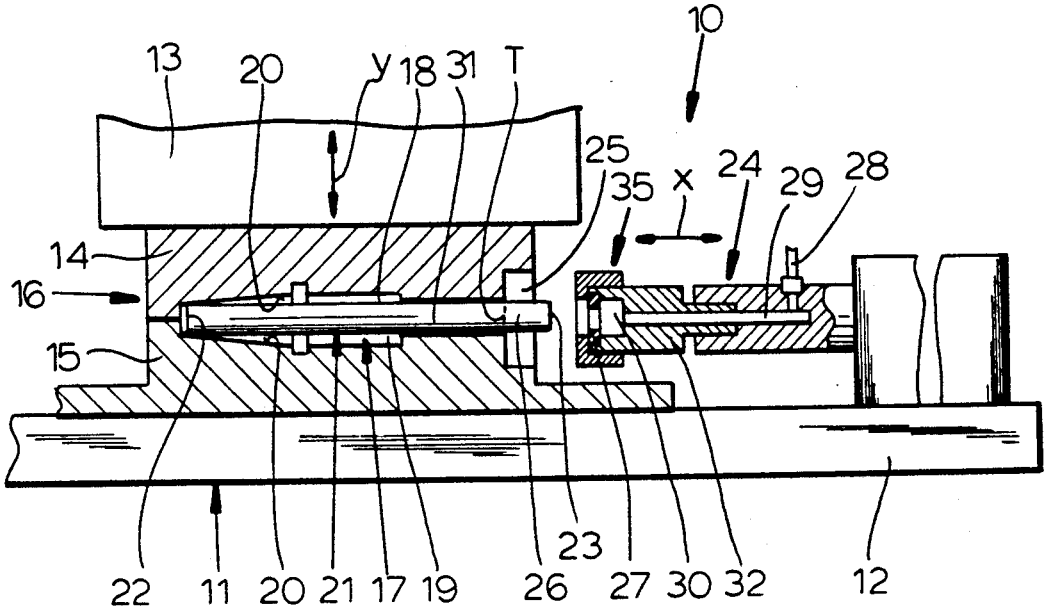
FIG. 1 is schematic longitudinal section through an apparatus according to a first embodiment.
Figure 2:
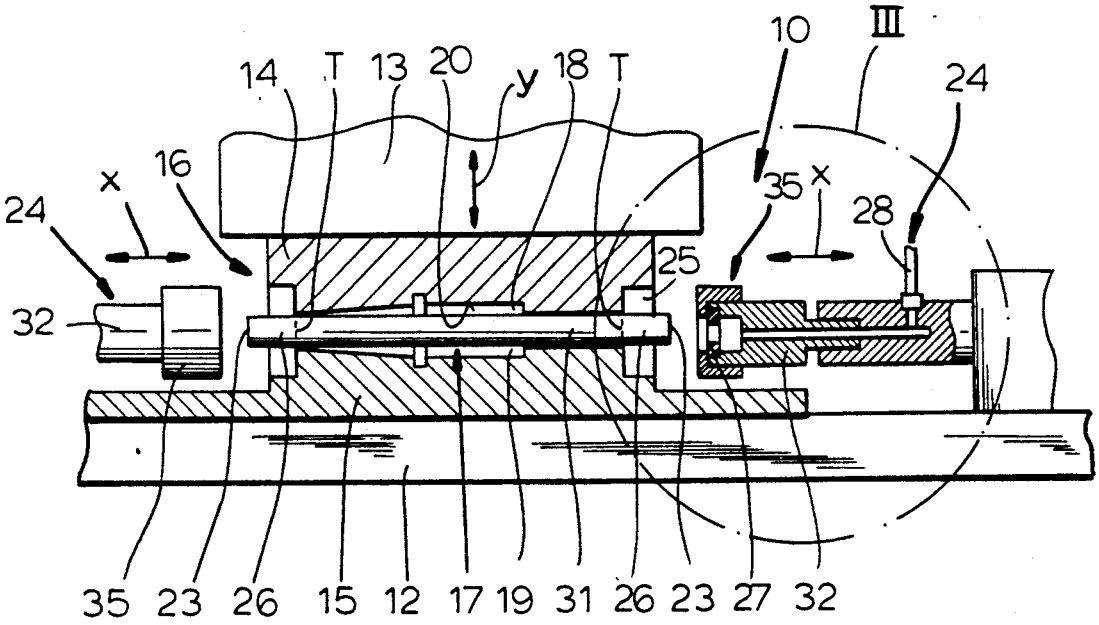
FIG. 2 is like FIG. 1 a schematic longitudinal section through a second embodiment.

In FIGS. 1 and 2 a schematically partly shown hydrostatic deforming apparatus is generally shown at reference 10.

The deforming apparatus has a press 11 with a stationary press table 12 and a press upper part 13 that can move relative thereto corresponding to the double-headed arrow shown at y and having a lower surface to which is fixed a die upper part 14 of a die 16 for joint movement. The die 16 has for the upper die part (upper die half) 14 a lower die part (die half) 15.

A die-cavity half 18 of the upper die half 14 and a die-cavity half 19 of the lower die half 15 together form a die cavity 17. The surface forming the inner surface, that is the engraving, of the die cavity 17 is indicated generally at 20.

According to FIG. 1 the die 17 is closed by downward movement of the press upper part 13. A tube (tubular hollow body) 21 is held in the cavity 17 and is made of a cold-shapable metal, e.g. of St 34 or St 38 or of another cold-shapable material.

The tube 21, below regardless of its extent of formation always referred to as a tubular hollow body, is in the embodiment of FIG. 1 provided on its one end with a floor 22 while its other end 23 is open.

In the arrangement according to FIG. 2 the tubular hollow body 21 has two open ends 23.

Figure 3:
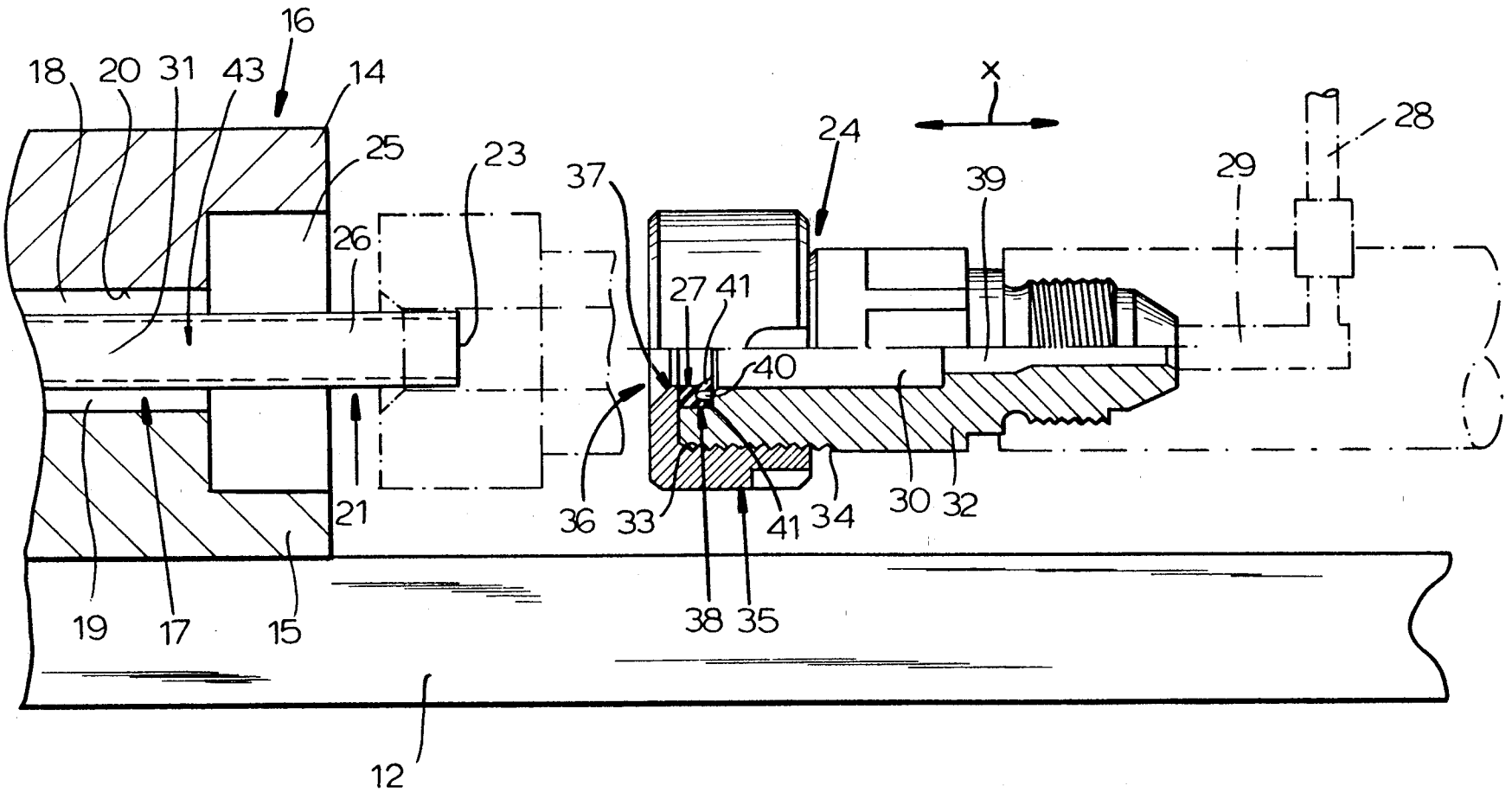
FIG. 3 is a partial longitudinal section corresponding to the region circled in LTI at FIG. 2 in enlarged scale.

In order to act on the tubular body 21 there is a feed sleeve 24 which is shown in large section in detail in FIG. 3.

The feed fitting 24 is movable back and forth translatorily as shown by the double-headed arrow x.

When the feed sleeve 24 is shifted so far to the left that it fits snugly in a recess 25 formed in the die, the fitting 24 engages sealingly around the holding region 26 of the tubular hollow body 21 with a ring cuff 27. When in this position the feed fitting is not movable relative to its movement direction x so that pressurized fluid from an unillustrated pressurized-fluid source is fed via the conduits 28 and 29 to the sleeve interior 30 and then passes via the open end 23 into the tubular body.

The effect of the pressure—as described in detail below—so deforms the tubular hollow body 21 that it plastically deforms to lie on the surface 20 of the die 16 and take on its shape.

The tubular body 21 is according to FIGS. 1 and 2 as shown with the dashed line T subdivided basically so that the tubular body 21 comprises the holding region 26 and a deformation region 31.

Since the tubular body according to FIG. 1 is provided on its one end with a floor 22 it only has one holding region 26 cooperating with a feed sleeve 24 while with a tubular hollow body 21 open at both ends (at 23) the body 21 has the deformation regions 26 delimited by the dashed line T.

Corresponding to FIG. 2 before the hydrostatic deformation by means of pressurized liquid both feed sleeves 24 are synchronously moved toward each other so that the pressurized liquid can be fed in over both fittings 24. It is also basically possible, for instance instead of the feed sleeve 24 shown in the left in FIG. 2 to provide an analogously made blind sleeve which is pressure-tight outward and thus engages with its gland 27 the FIG. 2 left-hand holding region 26 and thus assumes the function of the floor 22 of FIG. 1. Aside from its pressure-tight sealing such a blind fitting 24 is identical to a feed fitting 24.

FIG. 3 shows the feed fitting 24 in more detail. The feed fitting 24 has a sleeve body 32 with an external screwthread 34 which fits with the inner screwthread 33 of an outer nut 35. The outer nut 35 is provided with an intake opening 36 which is delimited by a frustoconical inner surface 37. An inner groove 38 between the outer nut 35 and the sleeve body 32 receives an annularly continuous gland seal 27 of limitedly flexible material, in particular of a particularly shape-stable synthetic resin. The gland seal has an annular groove open backward toward the pressure source and which is defined between an inner lip 42 and an outer lip 41 which are unitary with the gland 27. The gland 27 can thus spread automatically under the effect of the pressurized liquid.

In order to receive the hollow-body holding region 26 the feed fitting 24 moves along the direction x toward the left and thus moves past the dot-dash intermediate position until the outer nut 35 fits flush in the die recess 25. Meanwhile the gland seal 27 engages over the holding region 26. Then the feed sleeve 24 is blocked relative to the displacement direction x whereupon a hydraulic medium (preferably a watery emulsion which is intended for hydraulic purposes) is fed via 28, 29, 30, and 23 into the interior of the tubular hollow body 21 whereupon the widening hydraulic deformation, which constitutes a stretching shaping, takes place.

Figures 4, 4A, 5, 5A, 6, 6A:
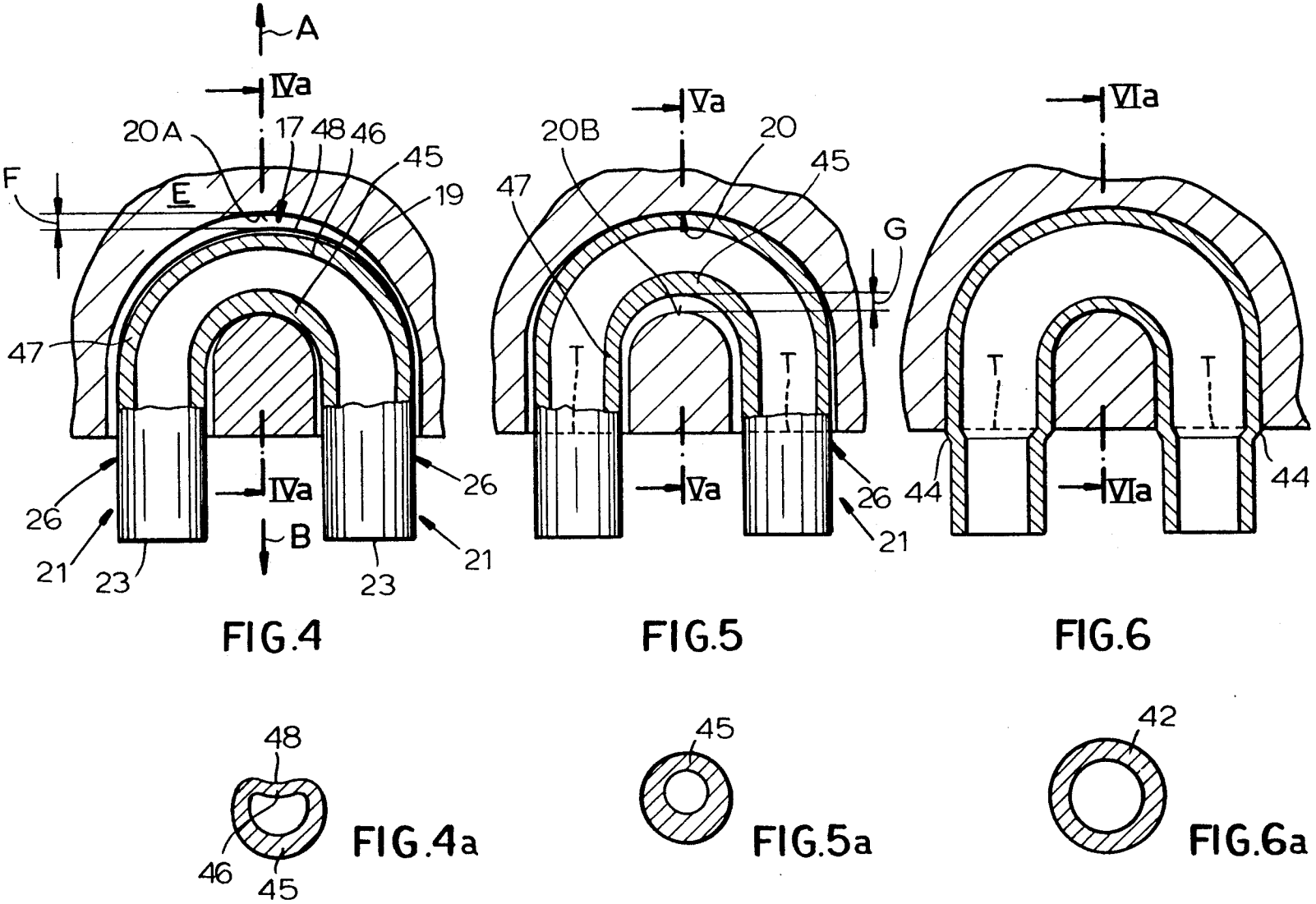
FIG. 4 and 4*a*, 5 and 5*a*, and 6 with 6*a* show the formation of a 180° bend in a die with corresponding sections of the tube curve.
Figure 9:
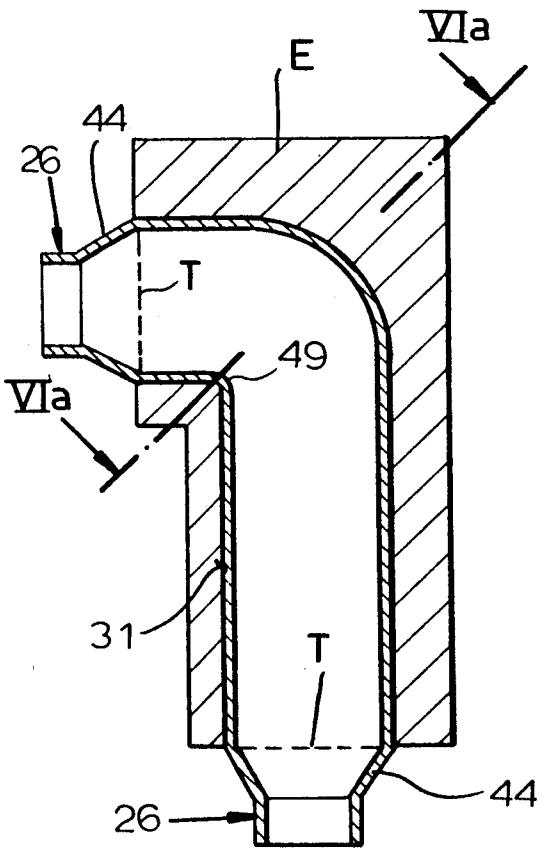
FIGS. 7 through 9 show the deformation of a 90° angle tube.
Figure 8:
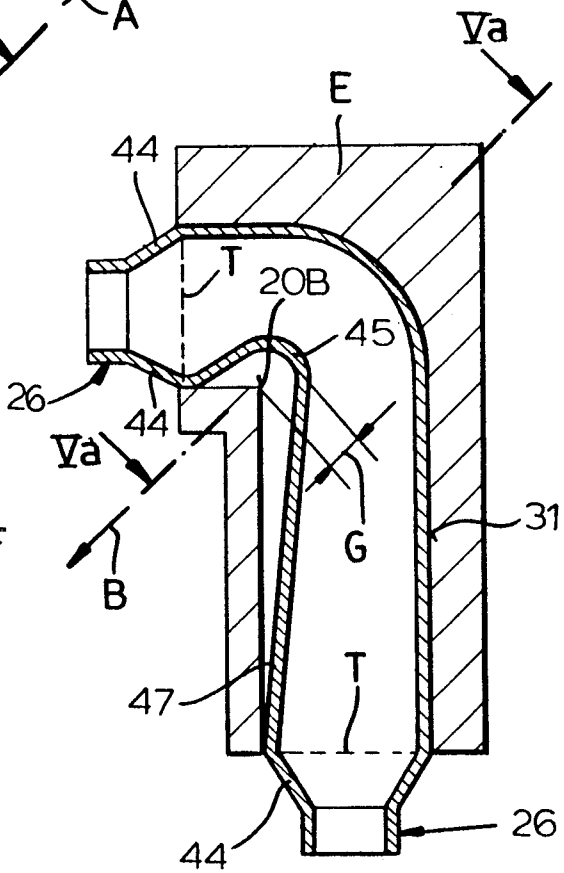

It could be that the hydrostatic deformation also takes place outside the die right up to the funnel-shaped intake opening 36, thereby forming a frustoconical outward deformation 44 as shown generally in FIGS. 6, 8, and 9.

In the case where—as described above—the feed fitting 24 is formed as a blind fitting, it is sufficient to make the rear parts of the fitting cavity 30 closed as shown to the right in FIG. 3 at the reference 39 and the dashed lead line.

The above descriptions should also show that the sleeve 24, whether a blind fitting or a feed fitting, sealingly surrounds the holding regions 26 but permits a movement of the tubular hollow body 21 relative to the fitting 24. This relative movement which is initiated only through the hydrostatic deformation pressure of the pressurized fluid, makes the method of the invention independent of an external axially mechanical force, e.g. by means of a press, and permits thin-walled workpieces 21 to be given practically any curved—and of course also straight —shape.

The inventive hydrostatic deformation is described in detail with reference to FIGS. 4–6 and the respective sections 4*a*–6*a* where analogous procedures are also given in this regard in FIGS. 7–9 which is made clear by the use of identical references for identical details.

The tubular body 21 shown in FIG. 4 is bent by an unillustrated standard tube-bending device into a tubular arc of 180°. The tube-bending device can for example correspond to the type shown in Austrian patent 272,072.

During the mechanical bending operation the tube 21 reacts differently along its neutral axis (longitudinal middle axis). Thus in the inside-curve region there is a thickening 45 caused by compression and in the outer-curve region a certain thinning 46 of the wall shown generally at 47. In the outer region (outer curve) the bending causes a longitudinal groovelike indent 48 to form.

During the formation of the curved pipe it is attempted to avoid fold formation in the inner curve of the tube as much as possible.

FIGS. 4–6 show how the hydrostatic deformation takes place.

A portion of the lower die 15 is shown which is a top view on the die dividing plane I. The surface of the die dividing plane is hatched to show it better.

The tube elbow 21 is according to FIG. 4 laid from above in the lower die half 19. Then the die 16 is closed as in the representation in FIGS. 1 and 2 and two unillustrated feed sleeves 24 are slid over the two holding regions 26 of the tube elbow 21 whose ends 23 are open. The two feed sleeves 24, of which one can be a blind sleeve, are then blocked against movement. The apparatus is now ready to feed in the hydrostatic pressure fluid.

Figure 11:
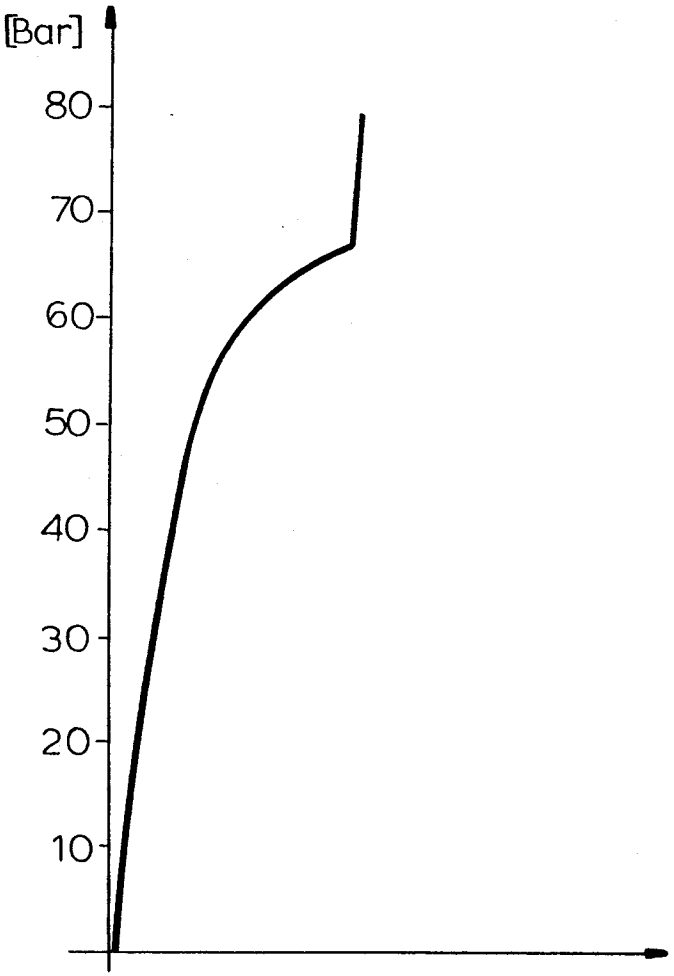
FIG. 11 is an enlarged detail corresponding to the region circled at XI in FIG. 10.
Figure 10:
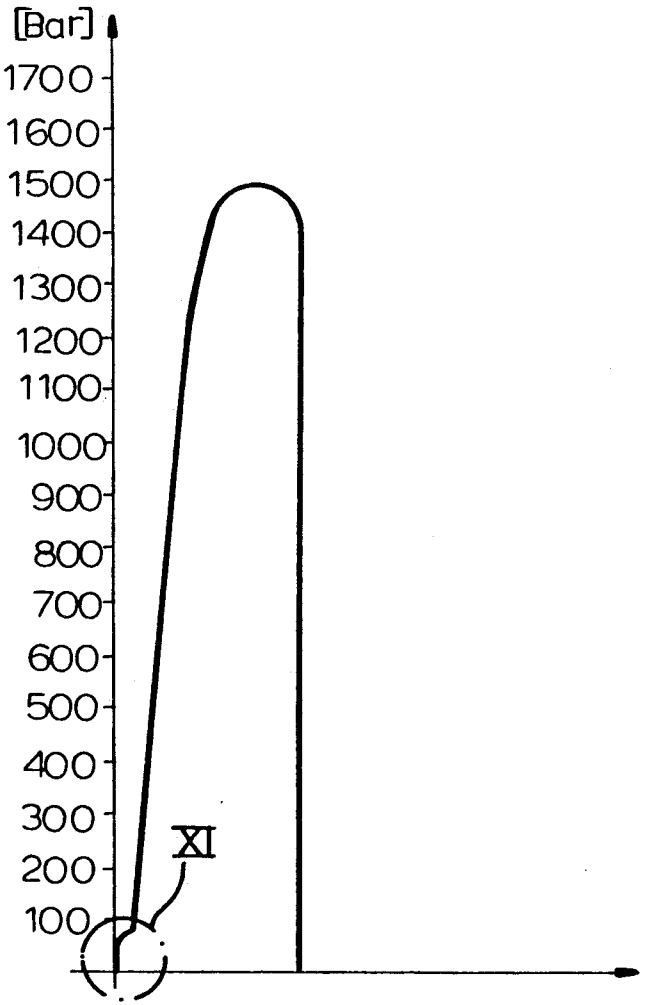
FIG. 10 is the overall pressure relationship during the deformation of a workpiece.

Feeding in the hydrostatic pressurized fluid takes place according to the pressure curve shown in FIGS. 10 and 11. FIG. 10 shows the pressure with respect to time in the interior 43 of the tubular hollow part 21 to be deformed. FIG. 11 shows in enlarged detail the pressure curve according to FIG. 10.

The pipe elbow 21 according to FIG. 4 is at first subjected to a filling pressure which according to FIG. 11 reaches a top pressure of about 65 bar. During the filling-pressure phase the pipe tube 21 already starts to move in direction A into the die cavity 10. The filling pressure is produced in a particular low-pressure part. As clearly to be seen from FIGS. 10 and 11 the filling pressure is increased by a steeply climbing deformation pressure (produced in a special high-pressure part) whose maximum in the case lies generally about 2500 bar, although it basically can rise to 3000 bar and higher.

During the increase of the deformation pressure the pipe tube 21 is drawn entirely along the direction A into the die cavity 17 whereupon at first the indent 48 (see FIG. 4*a*) formed as a longitudinal groove moves outward to position 20A against the surface 20A. Thus the tube cross section takes the position generally indicated in FIG. 5*a*. FIG. 5 clearly shows that the pipe-elbow outer surface has already mainly lain on the surface 20 at 20A. FIGS. 5 and 6 show the dashed division T which separates the holding region 26 from the deformation region 31 of the tube elbow 21.

It must be noted that the entire deformation process is only shown stepwise in FIGS. 4–6, which process can in fact take place continuously and without stopping.

The increasing deformation pressure finally serves to press the tube wall 47 in the deformation region 31 flat onto the wall surface 20, thereby widening the tube 21 while simultaneously stretching the wall 47. This means that in particular the thickened region 45, which is more easy to see in FIGS. 5 and 5*a*, lies against the direction A, namely in direction B, on the inner wall region 20B while being stretched, while the tube outer curve altogether is braced on the outer curve of the surface 20, as at 20A. The thus shaped tube 21 ends up with a uniform annular cross section as shown in FIGS. 6 and 6*a*.

Seen in detail the deformation of the tube elbow 21 takes place as follows: As a result of the larger effective surface in the outer-curve region, the tube elbow 21 at first moves in direction A into the die cavity and braces itself at the surface region 20A. The thicker wall region 45 of the inner side of the curve is then, required by the delayed higher pressure corresponding to FIGS. 10 and 11, pressed on the surface region 20B lying across from the inner curve side (at 45). It is thus clear that altogether an automatic equalization of the remaining wall thicknesses of the hollow-body wall 47 is effected. This takes place basically in that each inner radius (thus in FIG. 2 the tube inner side as seen in particular at 49 in FIG. 8) is freely chosen and thus allows the remaining wall thicknesses to be minimized.

It could be that by selective choice of the distances of the various tube outer-side surfaces from the confronting die-surface region it is possible to take control of the wall thickness over the deformation region. These spacings are shown for example in FIGS. 4 and 5 at F and G.

By way of completeness there remains still that the diameter of the holding regions 26 remains the same during the deformation. In order to get identical uses (usable workpieces), after deformation the holding region 26 along with the frustoconical widening 44 are cut off generally at the dashed line T.

In the described example according to FIGS. 4–6 a maximum deformation pressure of about 1350 bar was enough. In order however to compensate for irregularities in the starting material in particular material tolerances as well as if necessary small folds created by bending in the elbow inner side, and in order also in every case to produce workpieces of identical characteristics the sufficient deformation pressure is increased by 150 bar to 1500 bar.

As soon as the maximum pressure of 1500 bar is reached, the pressure is cut off and reduced suddenly to atmospheric pressure which is shown in FIG. 10 by a nearly vertical pressure drop. The deformation step corresponds to a full-pressure phase of about 1–2.5 s.

Figure 7:
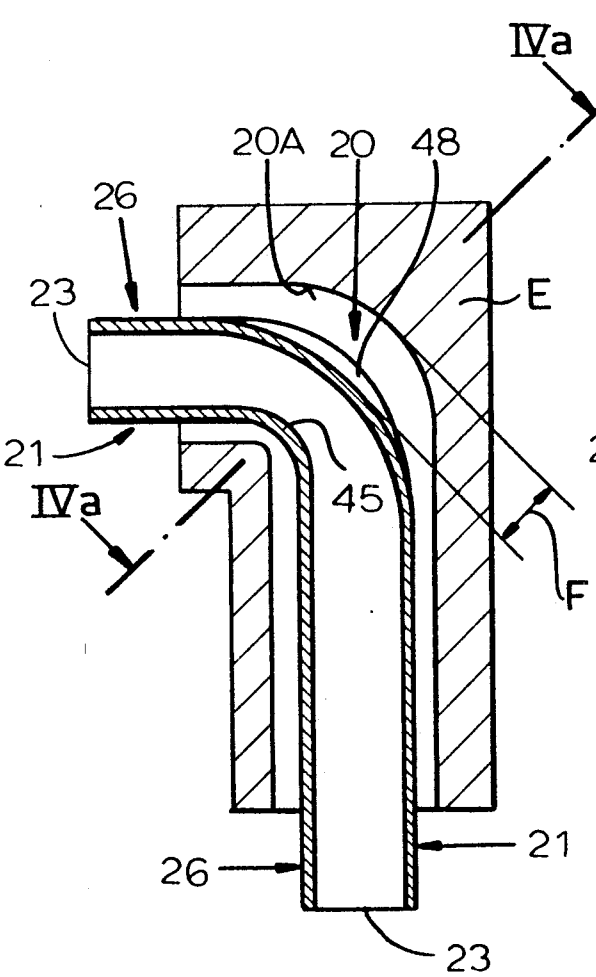

The deformation of 90° elbows corresponding to FIGS. 7–9 takes place analogously to the deformation of FIGS. 4–6 with the distinction that according to FIG. 8 (in contrast to FIG. 5) the frustoconical widenings 44 are already formed. The stretch deformation of the thickened region 45 takes place at the location 49 of the tube wall 47 according to FIG. 9 about a nearly zero radius. This nearly zero radius corresponds to the wall shape at 20B.

FIGS. 7–9 are analogous to FIGS. 4–6 and even the section lines are shown at IVa--IVa, Va--Va, and VIa--VIa so that basically FIGS. 4*a*, 5*a*, and 6*a* are valid except for scale differences for FIGS. 7–9. Even the deformation paths F and G corresponding to the deformation direction A and B are equally valid for the embodiment according to FIGS. 7–9.

Even the 90° elbow according to FIG. 7 is formed with a mechanical tube-bending tool. A longitudinal-groove indent 48 is seen in FIG. 7.

Similarly analogously the pressure curves of FIGS. 10 and 11 apply to FIGS. 7–9.

I claim:

1. A method of pressure deforming a hollow metal workpiece having a tubular end portion, the method comprising the steps of:

mechanically bending the workpiece into an intermediate nonstraight shape such that the workpiece has thickened regions of substantially greater wall thickness than other less-thick wall regions;

fitting the workpiece into a die formed with a cavity adapted to receive the workpiece with the end portion of the workpiece projecting along an axis out of the die;

positioning the workpiece in the die such that the thickened regions are spaced further from a die inner surface than the other less-thick regions;

engaging over the projecting end portion of the workpiece a feed sleeve in a pressure-tight fit;

supporting the sleeve and workpiece relative to each other such that the end portion can slide in the sleeve and that the sleeve exerts substantially no axial force on the workpiece; and pressurizing an interior of the workpiece through the sleeve and thereby deforming the workpiece outward against an inner surface of the die and axially sliding the workpiece end portion in the sleeve.

2. The pressure-deforming method defined in claim 1, further comprising the step before fitting the workpiece into the die of forming the workpiece with an indented region.

3. The pressure-deforming method defined in claim 1 wherein the interior of the workpiece is pressurized by first filling the interior with the liquid at a relatively low filling pressure and then increasing the pressure to a relatively high deformation pressure.

4. The pressure-deforming method defined in claim 3 wherein the deformation pressure is generally 30 to 50 times greater than the filling pressure.

5. The pressure-deforming method defined in claim 3 wherein the deformation pressure is at least 1350 bar.

6. The pressure-deforming method defined in claim 1 wherein the interior of the workpiece is pressurized by increasing the pressure in the workpiece in distinct steps.

7. The pressure-deforming method defined in claim 6 wherein after each distinct pressure step the workpiece is shifted to a different die.

8. The pressure-deforming method defined in claim 7, further comprising the step immediately prior to shifting the workpiece to a different die of normalizing the workpiece by heating it.

9. The pressure-deforming method defined in claim 1 wherein, when the interior of the workpiece is pressurized, air in the workpiece interior is compressed, the method further comprising the step of driving the liquid out of the interior of the workpiece after pressurizing same by releasing pressure on the liquid and letting the compressed air in the workpiece interior expand.

10. The pressure-deforming method defined in claim 1 wherein the workpiece is positioned in the die by initially orienting the workpiece in the die with the thickened region directed toward the sleeve such that on pressurization the workpiece shifts away from the sleeve into engagement with the die inner surface.

* * * * *